United States Patent [19]

Saito et al.

[11] Patent Number: 4,821,805

[45] Date of Patent: Apr. 18, 1989

[54] AUTOMATIC FIRE EXTINGUISHING SYSTEM

[75] Inventors: Yoshifusa Saito; Hiroshi Nakayama, both of Sagamihara; Hisao Fukui, Yokohama; Naoya Matsuoka, Yokohama, all of Japan

[73] Assignee: Hochiki Kabushiki Kaisha, Tokyo, Japan

[21] Appl. No.: 508,657

[22] Filed: Jun. 28, 1983

[30] Foreign Application Priority Data

Jun. 28, 1982 [JP] Japan ..... 57-111316
Jun. 28, 1982 [JP] Japan ..... 57-111317

[51] Int. Cl.[4] ..... A62C 35/00
[52] U.S. Cl. ..... 169/5; 169/61
[58] Field of Search ..... 169/54, 61, 1; 250/554; 356/1, 4, 44, 152; 239/263.1

[56] References Cited

U.S. PATENT DOCUMENTS 1,958,893 5/1934 Kintner et al. ..... 169/1
1,959,702 5/1934 Burke ..... 250/554 X
2,830,487 5/1955 Griffith ..... 356/1 X
3,588,893 6/1971 McCloskey ..... 169/61
3,633,010 1/1972 Suetlichny ..... 356/152 X
3,752,235 8/1973 Witkowski ..... 169/61

FOREIGN PATENT DOCUMENTS 2106385 4/1983 United Kingdom ..... 169/61

*Primary Examiner*—Andres Kashnikow
*Assistant Examiner*—Kevin P. Weldon
*Attorney, Agent, or Firm*—Armstrong, Nikaido, Marmelstein & Kubovcik

[57] ABSTRACT

An automatic fire extinguishing system wherein at least two fire detecting sensors are provided. The sensors are disposed at a distance from each other and movable in the horizontal and vertical directions to scan the region to be protected for detecting the angles of a fire source in the horizontal and vertical directions. A distance to the fire source is obtained from the angles of the fire source detected by the respective sensors. A discharge nozzle is set based on the fire source position determined by the angles and the distance of the fire source.

6 Claims, 9 Drawing Sheets

AUTOMATIC FIRE EXTINGUISHING SYSTEM

BACKGROUND OF THE INVENTION

1. Field of the Invention

This invention relates to an automatic fire extinguishing system in which at least two fire detecting sensors such as infrared detectors detect the position of a fire source and extinguishant discharge from a nozzle is directed towards the fire source.

2. Description of Prior Art

As an automatic fire extinguishing system which detects a fire and carries out fire extinguishing operation automatically, there has been widely known a sprinkler system. This sprinkler system, however, has the disadvantage that a considerable number of sprinkler heads should be provided so as to cover all over the region to be protected in preparation for a fire which will occur at a random position in the region. As a result, the system should inevitably be extensive and complicated in piping installation thereof.

To solve these problems, there have been proposed many systems in which not only a fire occurrence but a direction of a fire source is detected by a fire detecting sensor and a discharge nozzle is adjusted so as to be directed towards the detected fire source as disclosed for example in U.S. Pat. No. 3,752,235. These systems are advantageous as compared with the previous sprinkler system in that a reduced number of discharge nozzles can cover the region to be protected.

However, these conventional systems detect only the occurrence of a fire and the direction of the fire source, and they never detect a distance to the fire source. Thus, they fail to determine the accurate position of the fire source. More particularly, a fire does not always start on the floor as shown by a in FIG. 1, but it sometimes starts at the height h from the floor as shown by b in FIG. 1. When the fire source is on the floor as shown by a, a fire detecting sensor c detects the angle $\alpha_1$ of the fire source a and a nozzle d is directed towards the fire source a according to the detected angle $\alpha_1$. In this case, extinguishant discharged from the nozzle d can hit the fire source a. When the fire source is at the height h from the floor as shown by b, the fire detecting sensor c detects the angle $\alpha_2$ of the fire source and the nozzle d is adjusted to the detected angle $\alpha_2$. In this case, however, the automatic fire extinguishing system cannot determine the position of the fire source b because the height h of and the distance l to the fire source b are not known and extinguishant discharged is directed towards b' which is an intersect of an extended line of angle $\alpha_2$ and the floor. As a result, the extinguishant cannot hit the fire source b. Thus, accurate fire extinguishing operation is not always expected with the conventional automatic fire extinguishing systems.

OBJECTS OF THE INVENTION

It is therefore an object of the present invention to provide an automatic fire extinguishing system which detects both the direction of and distance to a fire source to determine an accurate position of the fire source thereby to enable the system to effect accurate fire extinguishing operation.

SUMMARY OF THE INVENTION

In accordance with the present invention, there is provided an automatic fire extinguishing system comprising: at least two fire detecting sensors which are disposed at a distance from each other and each rotatable in the horizontal and vertical directions to scan a region to be protected; said fire detecting sensors being adapted to detect boundary angles of the extent of a fire source in the horizontal direction and detect the lowermost angle of the fire source in the vertical direction; an operation unit which determines an angle of the fire source in the horizontal direction in the form of an average angle of the detected boundary angles of the fire source in the horizontal direction and processes the detected lowermost angle of the fire source in the vertical direction as an angle of the fire source in the vertical direction; said operation unit being further adapted to compute a distance to the fire source based on the horizontal and/or vertical angles of the fire source detected by the respective fire detecting sensors; at least one discharge nozzle which is rotatable in the horizontal and vertical directions; and a control unit which controls the direction of the discharge nozzle based on the horizontal and vertical angles of the fire source determined by the operation unit and the distance to the fire source computed by the operation unit.

DESCRIPTION OF THE EMBODIMENTS

Figure 1:
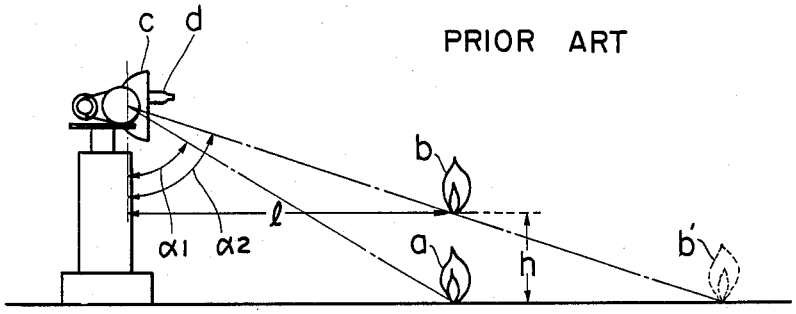
FIG. 1 PRIOR ART
FIG. 1 is an explanatory view showing a disadvantage of a conventional automatic fire extinguishing system.

Referring now to the drawings, there are illustrated preferred embodiments of the present invention.

FIGS. 2 to 7 illustrate a first embodiment of the present invention. This embodiment consists essentially of two fire detecting sensors which are disposed in tandem, keeping a distance in a vertical direction from each other, and each adapted to make horizontal and vertical scanning for detecting a fire. When the fire is detected, the angles at which the respective sensors detect the fire source are obtained during the vertical scanning of the sensors, and the distance in a horizontal direction to the fire source is calculated from the obtained angles. Thus, the fire source is located accurately to assure accurate fire extinguishing operation by a discharge nozzle wherever the fire starts from in the region to be protected.

Figure 2:
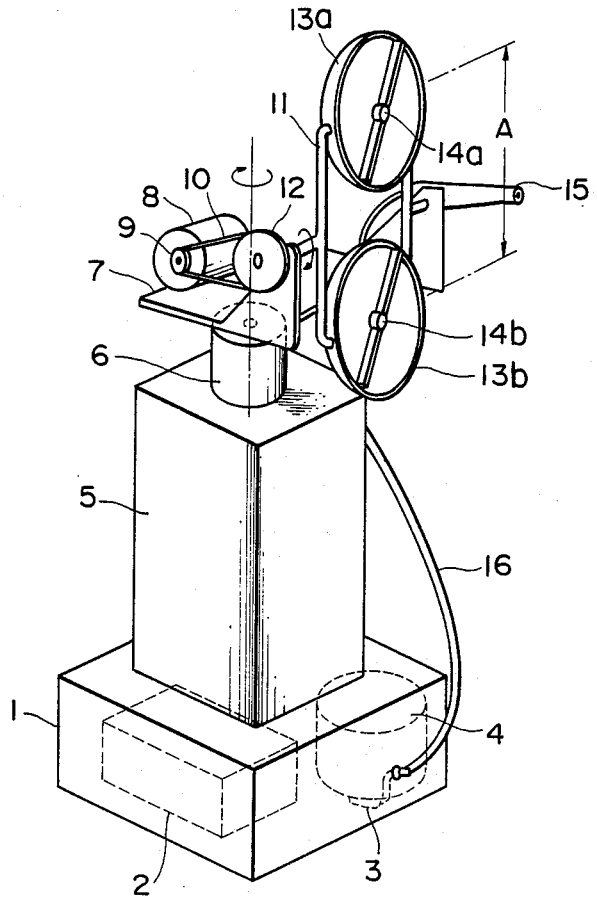
FIG. 2 is a perspective view of an automatic fire extinguishing system according to a first embodiment of the present invention.

The formation of the first embodiment will now be described more specifically. In FIG. 2, numeral 1 designates a base encasing therein a control circuit unit 2 and an extinguishant tank 4 provided with an extinguishing pump 3. A mounting table 5 is placed on the base 1 and a pulse motor 6 for horizontal scanning is mounted on the table 5. A rotary table 7 is mounted on a rotary shaft of the pulse motor 6 and a pulse motor 8 for vertical scanning is placed on the rotary table 7. The rotation of the pulse motor 8 is conveyed to a pulley 12 mounted on a rotary shaft of a support arm 11 through a belt 10 which is driven by a pulley 9 fixed to a rotary shaft of the motor 8. A pair of parabolic reflectors 13*a*, 13*b* are mounted on the support arm 11 so as to be spaced a distance A in the vertical direction from each other and rotated conjointly around the rotary shaft of the support arm 11. The parabolic reflectors 13*a*, 13*b* have, at the central positions thereof, infrared detectors such as pyroelectric transducers 14*a*, 14*b*, respectively, for detecting infrared ray emitted from a fire source. The parabolic reflectors 13*a*, 13*b* and the infrared detectors 14*a*, 14*b* constitute fire detecting sensors, respectively. A discharge nozzle 15 is also fixed to the support arm 11. The nozzle 15 is connected to the extinguishing pump 3 in the base 1 through a hose 16.

The parabolic reflectors 13*a*, 13*b* are rotated conjointly in the vertical direction around the rotary shaft of the support arm 11 by the pulse motor 8 and the discharge nozzle 15 is also rotated in the vertical direction by the motor 8 so as to tilt the tip thereof.

Although pulse motors are used for horizontal and vertical scanning in the embodiment as illustrated, another type of motors such as servomotors may be used alternatively. The parabolic reflectors 13*a*, 13*b* may be provided with filters, respectively, to prevent infrared rays other than the infrared ray radiated from the fire source from being incident upon the infrared detectors 14*a*, 14*b*.

Figure 3:
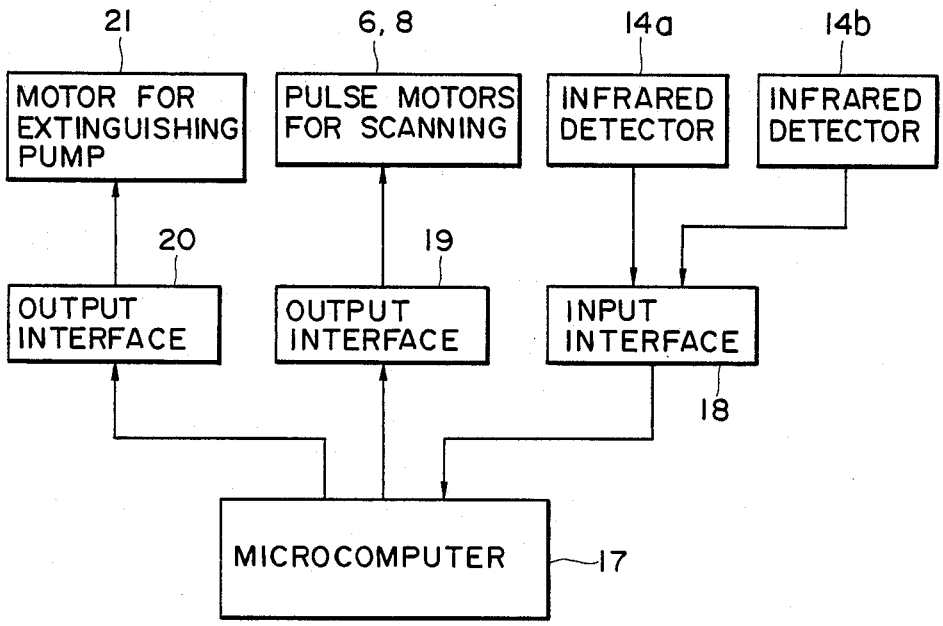
FIG. 3 is a block diagram of one form of control circuit unit of the first embodiment.

FIG. 3 is a block diagram of one example of the control circuit unit 2 of the embodiment as shown in FIG. 2.

A microcomputer 17 stores a monitoring and scanning program for rotating the two parabolic reflectors 13*a*, 13*b* in the horizontal and vertical directions, an operation program for computing a horizontal distance to the fire source based on the angles of the fire source detected by the fire detecting sensors, and a fire extinguishing program for setting the discharge nozzle 15 and actuating the extinguishing pump 3 to discharge extinguishant from the nozzle.

Outputs from the infrared detectors 14*a*, 14*b* are input to the microcomputer 17 through an input interface 18 and control outputs from the microcomputer 17 are given to the pulse motors 6, 8 for driving the fire detecting sensors through an output interface 19 and to a motor 21 for the extinguishing pump through an output interface 20.

The determination of the distance to the fire source according to the present embodiment will now be described referring to FIGS. 4A and 4B.

Figure 4A:
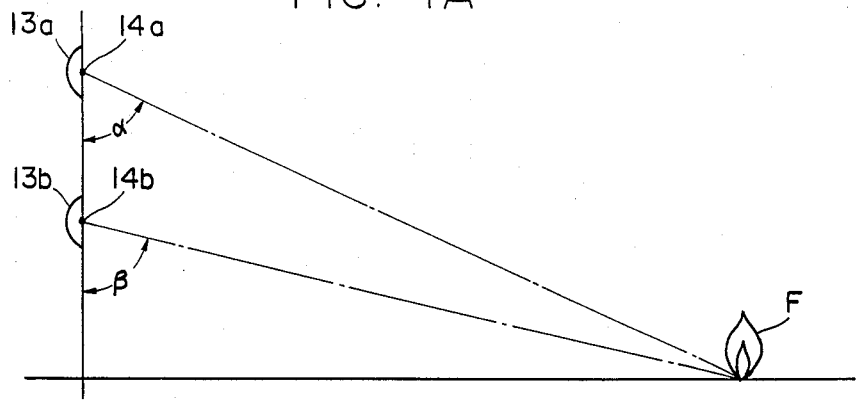
FIGS. 4A and 4B are explanatory views for calculation of a distance to a fire source according to the first embodiment.

When a fire starts at a position remote by a distance l from the automatic fire extinguishing system of the present embodiment as illustrated in FIG. 4A, the angle of a fire source F in the horizontal direction is first detected during the horizontal scanning by the parabolic reflectors 13*a*, 13*b*. The parabolic reflectors 13*a*, 13*b* are kept at the angle of the fire source in the horizontal direction and then rotated in the vertical direction. During this vertical scanning by the parabolic reflectors 13*a*, 13*b*, the infrared detector 14*a* on the parabolic reflector 13*a* first detects the fire source F at an angle $\alpha$ and the infrared detector 14*b* on the parabolic reflector 13*b* then detects the fire source F at an angle $\beta$.

Figure 4B:
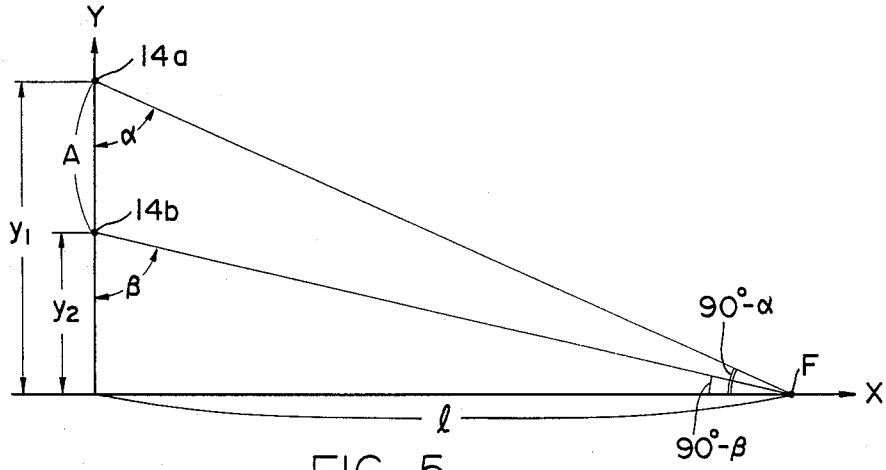

After these detection angles $\alpha$ and $\beta$ by the infrared detectors 14*a*, 14*b* are obtained during the vertical scanning of the parabolic reflectors 13*a*, 13*b*, a distance to the fire source F in the horizontal direction is calculated according to the trigonometry as illustrated in FIG. 4B.

Assuming that the space between the infrared detectors 14*a*, 14*b* is A and the horizontal distance to the fire source F is l, the distances of the infrared detectors 14*a*, 14*b* in the direction of Y-axis are:

$$y_1 = l \tan\left(\frac{\pi}{2} - \alpha\right) \tag{1}$$

$$y_2 = l \tan\left(\frac{\pi}{2} - \beta\right) \tag{2}$$

$$\text{Since } y_1 - y_2 = A, \tag{3}$$

there is obtained $$l = \frac{A}{\tan\left(\frac{\pi}{2} - \alpha\right) - \tan\left(\frac{\pi}{2} - \beta\right)} \tag{4}$$

Thus, the distance l in the horizontal direction can be calculated. This calculation can also be applied to the fire source b (FIG. 1) which is located at the height of h from the floor.

The height h from the floor is obtained by subtracting $y_1$ or $y_2$ obtained by the equation (1) or (2) from the vertical distance from the floor to the infrared detectors 14*a* or 14*b*.

The operation of the automatic fire extinguishing system according to the present embodiment will now be described.

In a normal monitoring condition, the pulse motors 6 and 8 are driven under the control of the program stored in the microcomputer 17 of the control circuit unit as shown in FIG. 3. First, the rotary table 7 and accordingly the fire detecting sensor mounted thereon are rotated by 360° by the pulse motor 6 and then the support arm 11 and the parabolic reflectors 13*a*, 13*b* which are initially directed horizontally are rotated in the vertical direction, downwardly by a predetermined angle by the pulse motor 8. The parabolic reflectors 13*a*, 13*b* are then rotated reversely by 360° in the horizontal direction by the pulse motor 6 to return the parabolic reflectors 13*a*, 13*b* to the initial position in the horizontal direction. Under this condition, the parabolic reflectors 13*a*, 13*b* are again rotated downwardly by the predetermined angle by the pulse motor 8. These horizontal and vertical rotating operations are repeated to carry out horizontal and vertical scanning of the region to be protected.

During this monitoring or scanning operation, if either one of the infrared detectors 14*a*, 14*b* on the parabolic reflectors 13*a*, 13*b* detects the infrared ray from a fire source, the rotary table 7 is returned to a reference position (initial position) by the pulse motor 6 while keeping the rotation angle or scanning angle of the parabolic reflectors 13a, 13b in the vertical direction. The horizontal scanning is started from this initial position and an angle of the fire source in the horizontal direction is obtained on the basis of the horizontal scanning angle where the fire source is detected.

Thereafter, the parabolic reflectors 13a, 13b are rotated in the vertical direction to their lowermost positions by the pulse motor 8 while keeping the horizontal angle of the rotary table 7 at the fire detected angle. The reflectors 13a and 13b are then rotated upwardly to start vertical scanning from their lowermost positions. Thus, as illustrated in FIGS. 4A and 4B, the angle $\alpha$ where the parabolic reflectors 13a detects the fire source F and the angle $\beta$ where the parabolic reflector 13b detects the fire source F are obtained.

The distance l to the fire source F in the horizontal direction is then calculated from the obtained angles $\alpha$ and $\beta$ according to the equation (4).

The discharge direction of the discharge nozzle 15 for discharging extinguishant towards the fire source is determined based on the horizontal distance l to the fire source and the height h of the fire source from the floor.

After the horizontal and vertical angle of the fire source and the horizontal distance to the fire source have been obtained, the discharge nozzle 15 is set to assume the calculated discharge angle by the pulse motor 8 and the extinguishing pump 3 is actuated to discharge, through the nozzle 15, the extinguishant in the tank 4 towards the fire source.

The discharge of the extinguishant from the nozzle 15 is continued for a predetermined period of time, and when the discharge is stopped, the parabolic reflectors 13a, 13b are again set at the fire detection angles to check whether the fire has been extinguished. If the fire is detected again, the extinguishant is again discharged towards the fire source. If no fire is detected, the parabolic reflectors 13a, 13b are reset to the normal monitoring condition.

For extinguishant discharge, the direction of the discharge nozzle 15 is determined considering the following facts. In general, the extinguishant discharged from the nozzle 15 falls describing a parabola, and this tendency is remarkable when the fire source is remote from the nozzle 15.

By this reason, the extinguishant cannot always reach the fire source when the angle of the discharge nozzle 15 is set to the detected angle of the fire source in the vertical direction. And, sometimes the discharge nozzle 15 fails to hit the fire source and the fire cannot be extinguished even if the fire is detected.

To solve this problem, the direction of the discharge nozzle 15 is modified so as to be adjusted upwardly with respect to the detected angle according to the horizontal distance to the fire source. As a result, the extinguishant from the nozzle 15 can positively hit the fire source even when the fire source is far away from the nozzle 15.

In this case, the microcomputer 17 stores a nozzle control program for setting the discharge nozzle 15 at a direction farther up than the detected angle of the fire source by an angle which depends upon the distance to the fire source.

Figure 5:
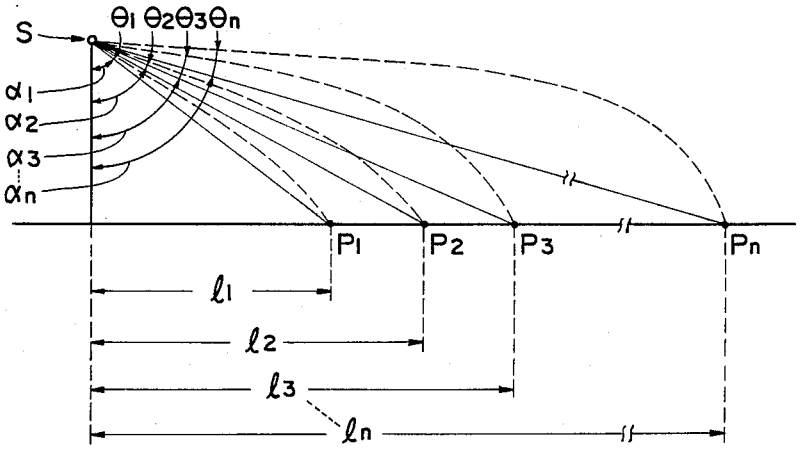
FIG. 5 is an explanatory view showing a relationship between the position of a fire source and the discharge curve.

FIG. 5 illustrates the manner for determining the discharge angle of the nozzle 15. In FIG. 5, the positions of the automatic fire extinguishing system including the infrared detectors 14a, 14b fixed to the parabolic reflectors 13a, 13b and the nozzle 15 is designated by S, the positions of the fire sources are designated by $P_1$ to $P_n$ and the distances to the respective fire sources $P_1$ to $P_n$ are designated by $l_1$ to $l_n$. The distance $l_n$ is the limit of the protection by the present automatic fire extinguishing system.

The angles in the vertical direction of the fire sources $P_1$ to $P_n$ viewed from S are designated as $\alpha_1$ to $\alpha_n$. These angles $\alpha_1$ to $\alpha_n$ are obtained in the form of the vertical angles of the parabolic reflectors 13a, 13b when the infrared detectors 14a, 14b fixed thereto detect the fire sources.

In this connection it is to be noted that the experiments conducted by the inventors of the present invention have revealed that the loci of the extinguishant discharged from the discharge nozzle 15 describe parabola as shown by broken lines. Therefore, to set the discharge angle of the discharge nozzle 15 so that the extinguishant discharged from S reaches the fire source $P_1$ to $P_n$, the detected angles $\alpha_1$ to $\alpha_n$ should be amended to angles $\theta_1$ to $\theta_n$ according to the result of the experiment as described above.

In accordance with the present invention, the amended angles $\theta_1$ to $\theta_n$ of the discharge nozzle 15 relative to the detected vertical angles $\alpha_1$ to $\alpha_n$ of the fire sources $P_1$ to $P_n$ are preliminarily obtained by experiments and stored in the control circuit unit 2, and the amended angle $\theta_n$ corresponding to the detected angle $\alpha_n$ is read out when the fire source $P_n$ is detected so that the discharge nozzle 15 is set at the angle $\theta_n$, i.e., directed slightly more upwardly than the angle $\alpha_n$.

Alternatively, the direction of the discharge nozzle 15 may be set as follows: first, the horizontal distances $l_1$ to $l_n$ to the fire sources $P_1$ to $P_n$ are computed based on the detected vertical angles $\alpha_1$ to $\alpha_n$, the initial speed of the extinguishant is incorporated into a preliminarily obtained parabolic formula as a parameter to calculate the setting angles of the discharge nozzle 15 for the distances $l_1$ to $l_n$, and the discharge nozzle 15 is set to the calculated angles.

The discharge nozzle 15 directed at the set angle as described above may be shaken up and down within a predetermined range to enhance the fire extinguishing effect.

It is further to be noted that the extinguishant discharged from the nozzle 15 has a tendency to spread wider as the distance is increased. To obtain suitable spraying area irrespective of the distance to the fire source, the discharge condition of the nozzle 15 may be varied depending upon the distance to the fire source to be sprayed. More specifically, when the fire source is near the discharge nozzle 15, the discharge nozzle 15 may be controlled to discharge broader flow of the extinguishant and when the fire source is remote from the nozzle 15, it may be controlled to discharge narrower flow of extinguishant.

Figure 6:
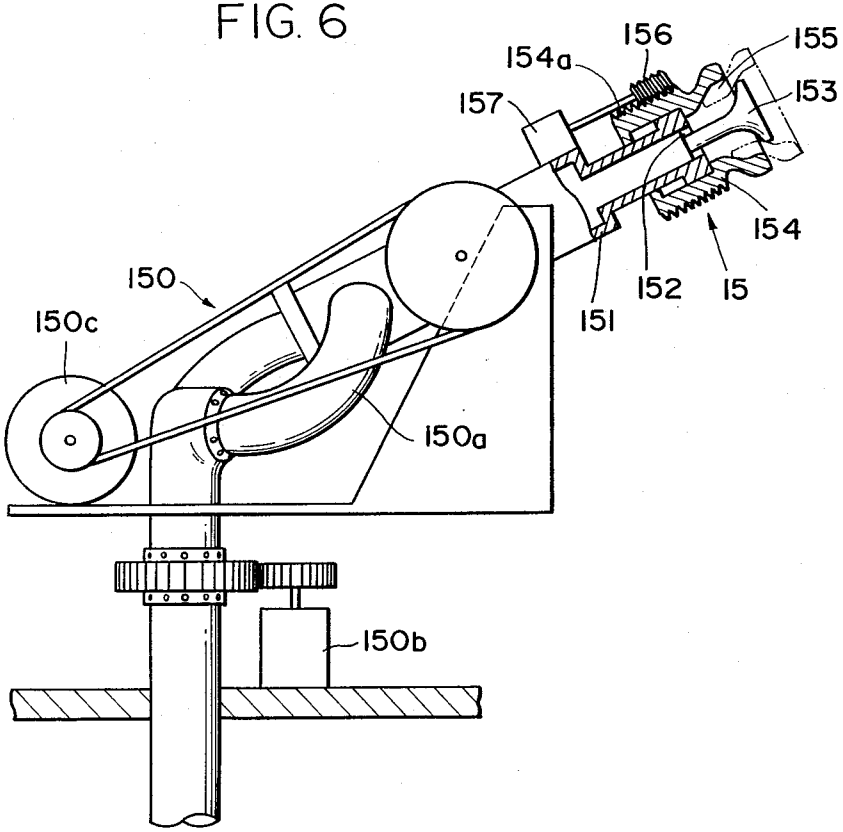
FIG. 6 is a partially sectional side elevational view of one form of a discharge nozzle.

As the discharge nozzle 15 which can be controlled to vary the discharge condition as described above, a nozzle having a structure as illustrated in FIG. 6 may be employed. The nozzle 15 as illustrated in FIG. 6 is comprised of a nozzle body 151, a conical member 153 fitted in the body 151 leaving a space 152 therearound and a cylindrical member 154 slidably fitted around the body 151. The outlet of the nozzle is defined between the conical member 153 and the conical member 154 and the area of the outlet is varied by moving the cylindrical member 154 along the axis thereof. More specifically, as the cylindrical member 154 is advanced, the area is increased, and as the cylindrical member 154 is retired backwardly, the area is reduced. The movement of the cylindrical member 154 in the axial direction is carried out by a thread 154*a* formed on the outer surface of the cylindrical member 154, a worm gear 156 in mesh with the thread 154*a* and a motor 157 for rotating the worm gear 156. In this case, the microcomputer 17 of the control circuit unit 2 stores a program for controlling the rotation of the worm gear 156 to advance or retreat the cylindrical member 154 according to the distance to the fire source.

Although the discharge nozzle 15 has a drive mechanism 150 independent of that of the fire detecting sensor in FIG. 6, this type of nozzle may be applied to the arrangement as illustrated in FIG. 2. In FIG. 6, 150*a* is a flexible tube, 150*b* is a motor for driving in the horizontal direction and 150*c* is a motor for driving in the vertical direction. The nozzle driving mechanism may have substantially the same structure as that of the drive mechanism for the fire detecting sensors in FIG. 2.

In case the driving mechanism 150 for the nozzle 15 is provided independently of the drive mechanism for the fire detecting sensors, there can be obtained the following advantage. In case the parabolic reflectors 13*a*, 13*b* and the discharge nozzle 15 are driven in the horizontal and vertical direction by the same pulse motors 6, 8 as in the arrangement of FIG. 2, extinguishment of the fire cannot be confirmed by the infrared detectors 14*a*, 14*b* fixed to the parabolic reflectors 13*a*, 13*b* during the discharge of extinguishant by the nozzle 15 set towards the fire source because the set angle of the nozzle 15 differs from the angles of the fire detected by the fire detecting sensors. By this reason, the discharge of extinguishant must be stopped for a while to direct the parabolic reflectors 13*a*, 13*b* towards the fire source for confirming that the fire is extinguished. Thus, the fire extinguishing operation and confirmation operation cannot be carried out simultaneously. In contrast, in case the drive mechanism for the nozzle 15 is independent of the driving mechanism for the fire detecting sensors, the watching of the fire source can be carried out while allowing the discharge nozzle 15 to discharge the extinguishant towards the fire source. In addition, the spread of the fire can be watched by scanning the vicinity of the fire source by the fire detecting sensors simultaneously with discharging of the extinguishant, and if necessary, the direction of the nozzle can be changed to avoid further spread of the fire.

In this case, the microcomputer 17 of the control circuit unit 2 stores a nozzle control program for driving the pulse motors 150*a*, 150*b* to direct the nozzle 15 towards the fire source.

The fire extinguishing operation in the case where the independent nozzle drive mechanism is provided will now be described.

When the infrared detectors 14*a*, 14*b* on the parabolic reflectors 13*a*, 13*b* detect infrared rays from a fire source during the scanning of the fire detecting sensors in the horizontal direction, the parabolic reflectors 13*a*, 13*b* are at once returned to a reference position, keeping the vertical angles where they detect the fire source and then driven in the horizontal direction, until they detect the fire source again. Thus, the angle of the fire source in the horizontal direction is obtained as the number of driving (pulse number) of the pulse motor 6.

Then, the parabolic reflectors 13*a*, 13*b* are driven by the pulse motor 8 to be directed to the lowermost position (a reference position in the vertical direction), keeping the angle in the horizontal direction where they detect the fire source, and driven upwardly until they detect the fire source. Thus, the angle of the fire source in the vertical direction is obtained as the number of the driving (pulse number) of the pulse motor 8.

The pulse motors 150*b* and 150*c* are operated in association with the so detected horizontal and vertical angles of the fire source to set the discharge nozzle 15 at an angle where the extinguishant from the nozzle 15 can hit the fire source. After completion of setting of the discharge nozzle 15, the extinguishing pump 3 is actuated to discharge the extinguishant towards the fire source.

On the other hand, independent of the control operation of the nozzle 15, the watching of the fire source is carried out by the infrared detectors 14*a*, 14*b* on the parabolic reflectors 13*a*, 13*b* simultaneously, and the condition of the fire source is real-time detected. Upon confirmation of fire extinguishment, the discharge of extinguishant is stopped and the initial monitoring is started again.

In the watching of the fire source during extinguishant discharge, the parabolic reflectors 13*a*, 13*b* may be driven to make horizontal and vertical scanning within a range around the detected angles of the fire source to watch not only the original fire source but possible spread of the fire. If the spread of the fire is detected, the discharge nozzle 15 is set towards the spread of the fire after confirmation of extinguishment of the original fire source.

In this connection, it is to be noted that in a case where infrared detectors such as pyroelectric transducers are used in the fire detecting sensors, they are used in combination with parabolic reflectors to impart directional characteristic developed over a certain angular range to the sensors. In this case, however, the sensors generate outputs when the fire source enters said angular range of directional characteristic. As a result, the fire source is detected at an angle deflected from the center of the range. If the extinguishant is discharged at the so detected angle, it cannot fall on the fire source.

To solve this problem, an angle where the fire source is first detected and an angle where the fire source first gets out of the detection are obtained in the scanning in the horizontal direction and the angles are averaged. Thus, the average angle is obtained as an angle of the fire source in the horizontal direction.

Figure 7A:
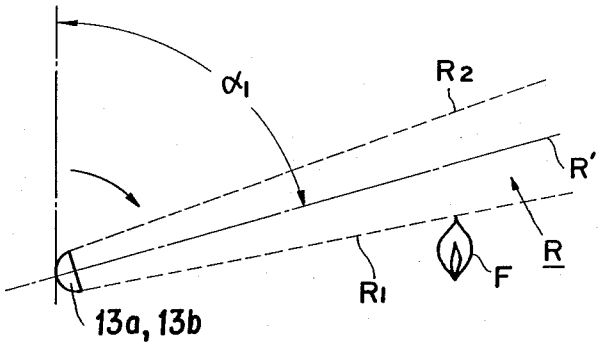
FIGS. 7A and 7B are explanatory views for determination of a horizontal angle of a fire source.
Figure 7B:
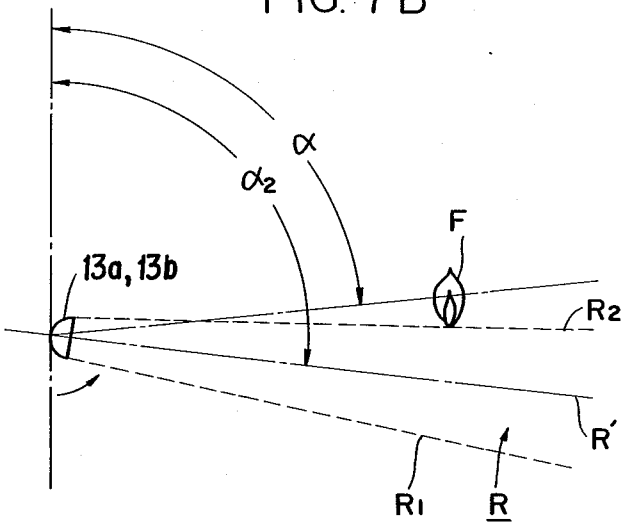

This operation will be described in detail referring to FIGS. 7A and 7B.

When the infrared detector 14*a*, 14*b* on the parabolic reflector 13*a*, 13*b* as shown in FIG. 2 detects the fire source during the horizontal and vertical scanning, the scanning operation by the parabolic reflector 13*a*, 13*b* is stopped and the parabolic reflector 13*a*, 13*b* is once returned to its horizontal reference position, keeping it at the vertical angle where it detects the fire source. The parabolic reflector 13*a*, 13*b* is then driven in the horizontal direction as illustrated in FIG. 4A, and when the fire source F enters a boundary $R_1$ of the angular range R, the infrared detector 14*a*, 14*b* detects the fire source F and an angle $\alpha_1$ where the detector generates an output is obtained. The parabolic reflector 13*a*, 13*b* is further driven in the horizontal direction, and when the fire source F gets out of another boundary $R_2$ of the range R, the output from the infrared detector 13*a*, 13*b* disappears and an angle $\alpha_2$ where the output disappears is obtained.

Thereafter, a horizontal angle $\alpha$ of the fire source F is obtained by the following calculation:

$$\alpha = \frac{\alpha_1 + \alpha_2}{2} \quad (5)$$

The average angle $\alpha$ of the angles $\alpha_1$ and $\alpha_2$ is an angle which coincides with a center axis line of the parabolic reflector 13*a*, 13*b* which passes through substantially the center of the fire source F. Thus, the angle of the fire source F can be detected accurately, irrespective of the directional range of the parabolic reflector 13*a*, 13*b*.

Thereafter, the parabolic reflector 13*a*, 13*b* is first driven to the lowermost position, keeping the horizontal angle of the fire source and then driven upwardly until the detector 14*a*, 14*b* detects the fire source F. Thus, the vertical angle of the fire source F can be obtained. In this respect, it is to be noted that the fire source is not located at the top of the flame but at the bottom of the flame and therefore the angle where the infrared ray from the fire source is first detected in the vertical scanning from the lowermost position can be recognized as the true vertical position of the fire source F.

The horizontal and vertical angles of the fire source F may be calculated based on the detection of either one of the detectors 14*a*, 14*b*.

The second embodiment of the present invention will now be described referring to FIG. 8.

The automatic fire extinguishing system according to this embodiment consists essentially of fire detecting sensors 103*a*, 103*b* disposed on a table 102 of a body 101 at a horizontal distance from each other and rotatable in the horizontal and vertical directions, a discharge nozzle 104 disposed on the table 102 at a position intermediate between the fire detecting sensors 103*a*, 103*b*, a control circuit unit 105 provided inside of the body 101, an extinguishing pump 107 and an extinguishant tank 108 provided inside of the body 101 and connected to the discharge nozzle 104 through a pipe 106, a general monitoring sensor 109 provided on the body 101 at a position where the sensor 109 can look all over the region to be protected, an alarm buzzer 110 and an indication lamp 111.

This second embodiment differs from the first embodiment in that the fire detecting sensors 103*a*, 103*b* are juxtaposed in the horizontal direction, the fire detecting sensors 103*a*, 103*b* each have drive mechanisms 112*a*, 113*b* which are independent of each other, respectively, the discharge nozzle 104 has its own drive mechanism 113 independent of the drive mechanisms 112*a*, 113*b* for the fire detecting sensors 103*a*, 103*b*, and the general monitoring sensor 109 is provided additionally.

The construction of each of the fire detecting sensors 103*a*, 103*b* is substantially the same as that of the fire detecting sensor employed in the first embodiment, and each of the sensors 103*a*, 103*b* has a parabolic reflector 114*a*, 114*b* and infrared detector 115*a*, 115*b* such as a pyroelectric transducer, respectively. The drive mechanisms 112*a*, 112*b* of each of the fire detecting sensors 103*a*, 103*b* and the drive mechanism 113 of the discharge nozzle 104 are substantially the same as the drive mechanism employed in the first embodiment.

Since two fire detecting sensors are provided keeping a space therebetween and each adapted to detect the direction of the fire source from the respective positions, the distance to the fire source can be obtained as in the first embodiment.

The calculation of the distance to the fire source will now be described referring to FIGS. 9A and 9$B_1$ to 9$B_3$.

Figure 9A:
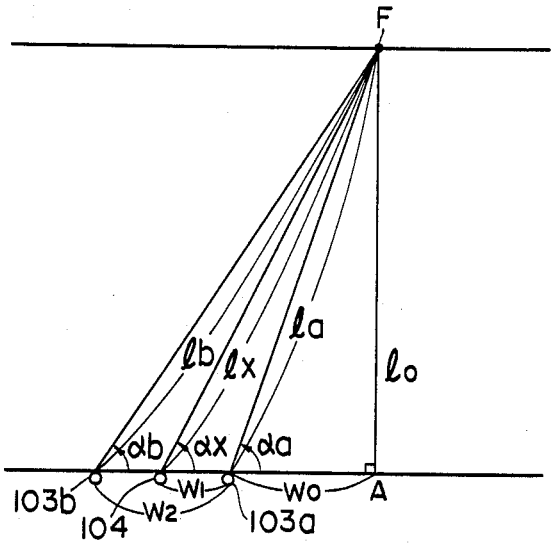
FIGS. 9A and 9B$_{1\ to\ 3}$ are explanatory views for calculation of a distance to a fire source according to the second embodiment.

FIG. 9A is an explanatory plan view of the fire detecting the automatic fire extinguishing system, i.e. sensors 103*a*, 103*b* and the discharge nozzle 104 shown in relation with a fire source F. $l_o$ designates a distance in the horizontal direction between the automatic fire extinguishing system and the fire source F. $l_a$ designates a horizontal distance between the fire detecting sensor 103*a* and the fire source F, $l_x$ designates a horizontal distance between the discharge nozzle 104 and the fire source F, and $l_b$ designates a horizontal distance between the fire detecting sensor 103*b* and the fire source F. $\alpha_a$ is a horizontal angle of the fire source F as viewed from the fire detecting sensor 103*a* and $\alpha_b$ is a horizontal angle of the fire source F as viewed from the fire detecting sensor 103*b*. The horizontal angles $\alpha_a$ and $\alpha_b$ are obtained in the form of the number of driving (pulse number) of the pulse motors 112*a*, 112*b*. $\alpha_x$ is a horizontal angle of the fire source F as viewed from the discharge nozzle 104. $W_o$ is distance between the fire detecting sensor 103*a* and a point A which is an intersection between an extension of the line connecting the fire detecting sensors 103*a* and 103*b* and the perpendicular thereto. $W_1$ is a distance between the fire detecting sensor 103*a* and the discharge nozzle 104 and $W_2$ is a distance between the fire detecting sensors 103*a* and 103*b*. The distances $W_1$ and $W_2$ are fixed in the present embodiment.

Under these conditions, the distance $l_o$ is obtained as follows:

$$l_o \tan\left(\frac{\pi}{2} - \alpha_b\right) - l_o \tan\left(\frac{\pi}{2} - \alpha_a\right) = W_2 \quad (6)$$

$$l_o = \frac{W_2}{\tan\left(\frac{\pi}{2} - \alpha_b\right) - \tan\left(\frac{\pi}{2} - \alpha_a\right)}$$

The distance $l_a$ is obtained as follows:

$$l_a \sin \alpha_a = l_o \quad (7)$$

$$l_a = \frac{l_o}{\sin \alpha_a}$$

The horizontal angle $\alpha_x$ is obtained as follows:

$$\tan \alpha_x = \frac{l_o}{W_1 + W_o} \quad (8)$$

Since $W_o = l_a \cos \alpha_a$, $$\tan \alpha_x = \frac{l_o}{W_1 + l_a \cos \alpha_a}$$

$$\alpha_x = \tan^{-1}\left(\frac{l_o}{W_1 + l_a \cos \alpha_a}\right)$$

$l_o$ and $l_a$ in the equation (8) are substituted with the equations (6) and (7) to obtain $\alpha_x$.

The distance $l_x$ is obtained as follows:

$$l_x \sin \alpha_x = l_o \quad (9)$$

-continued $$l_x = \frac{l_o}{\sin \alpha_x}$$

$l_o$ and $\alpha_x$ of the equation (9) are substituted with the equations (6) and (8) to obtain the distance $l_x$.

Figure 9B:
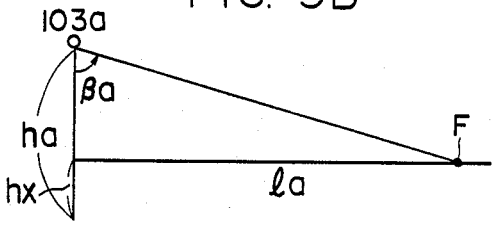
Figure 9B:
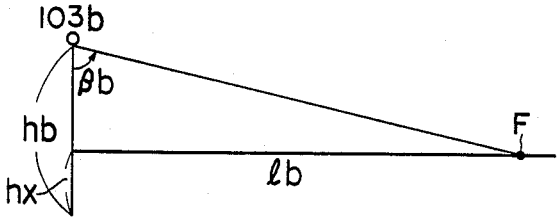
Figure 9B:
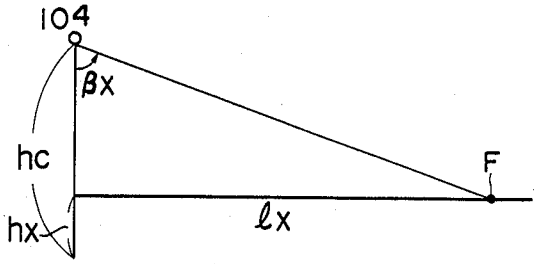

FIGS. 9B$_1$ to 9B$_3$ are vertical side elevational views of the fire detecting sensors 103*a*, 103*b* and the discharge nozzle 104 in relation with the fire source F.

In FIGS. 9B$_1$ to 9B$_3$, $h_a$, $h_b$ and $h_c$ are heights of the fire detecting sensors 103*a* and 103*b* and the discharge nozzle 104 from the floor, respectively. $h_x$ is a height of the fire source F from the floor. $\beta_a$ and $\beta_b$ are vertical angles of the fire source F as viewed from the fire detecting sensors, 103*a*, 103*b*, respectively, and obtained in the form of the number of driving pulses (pulse number) of the pulse motors 112*a*, 112*b*. $\beta_x$ is a vertical angle of the fire source as viewed from the discharge nozzle 104.

The height $h_x$ is obtained as follows:

$$\tan \beta_a = \frac{l_o}{h_a - h_x} \quad h_a - h_x = \frac{l_a}{\tan \beta_a} \tag{10}$$

$$h_x = h_a - \frac{l_a}{\tan \beta_b}$$

The angle $\beta_x$ is obtained as follows:

$$\tan \beta_x = \frac{l_x}{h_c - h_x} \tag{11}$$

$$\beta_x = \tan^{-1}\left(\frac{l_x}{h_c - h_x}\right)$$

$l_x$ and $h_x$ of the equation (11) are substituted by the equations (9) and (10) to obtain $\beta_x$.

The distance from the discharge nozzle 104 to the fire source F is obtained by the formulae (8) to (11).

The general monitoring sensor 109 provided in the present embodiment is preferably a sensor which can monitor all over the region to be protected and can detect the general direction of a fire source. As the general monitoring sensor 109, there can be mentioned for example an image sensor employing CCDs (charge coupled devices) as light sensing elements. When such CCD is used, the general direction of the fire source can be known by the position of the CCD where an output is generated. The general monitoring sensor 109 is formed, for example, in such a manner that a light receiving element such as CCD is disposed at a bottom of a cylindrical body which has a fisheye lens at the front thereof and fixed to the main body 101 of the automatic fire extinguishing system. This arrangement imparts a wide view to the general monitoring sensor 109.

In the present embodiment, the general monitoring sensor 109 carries out normal monitoring of the whole region to be protected, i.e., primary detection of a fire and the fire detecting sensors 103*a* and 103*b* carry out secondary fire detection around a fire source which are adapted to be actuated only when the general monitoring sensor 109 has detected the fire. Thus, power which would otherwise be consumed for driving the motors for the fire detecting sensors 103*a*, 103*b* at a normal time can be saved.

Figure 10:
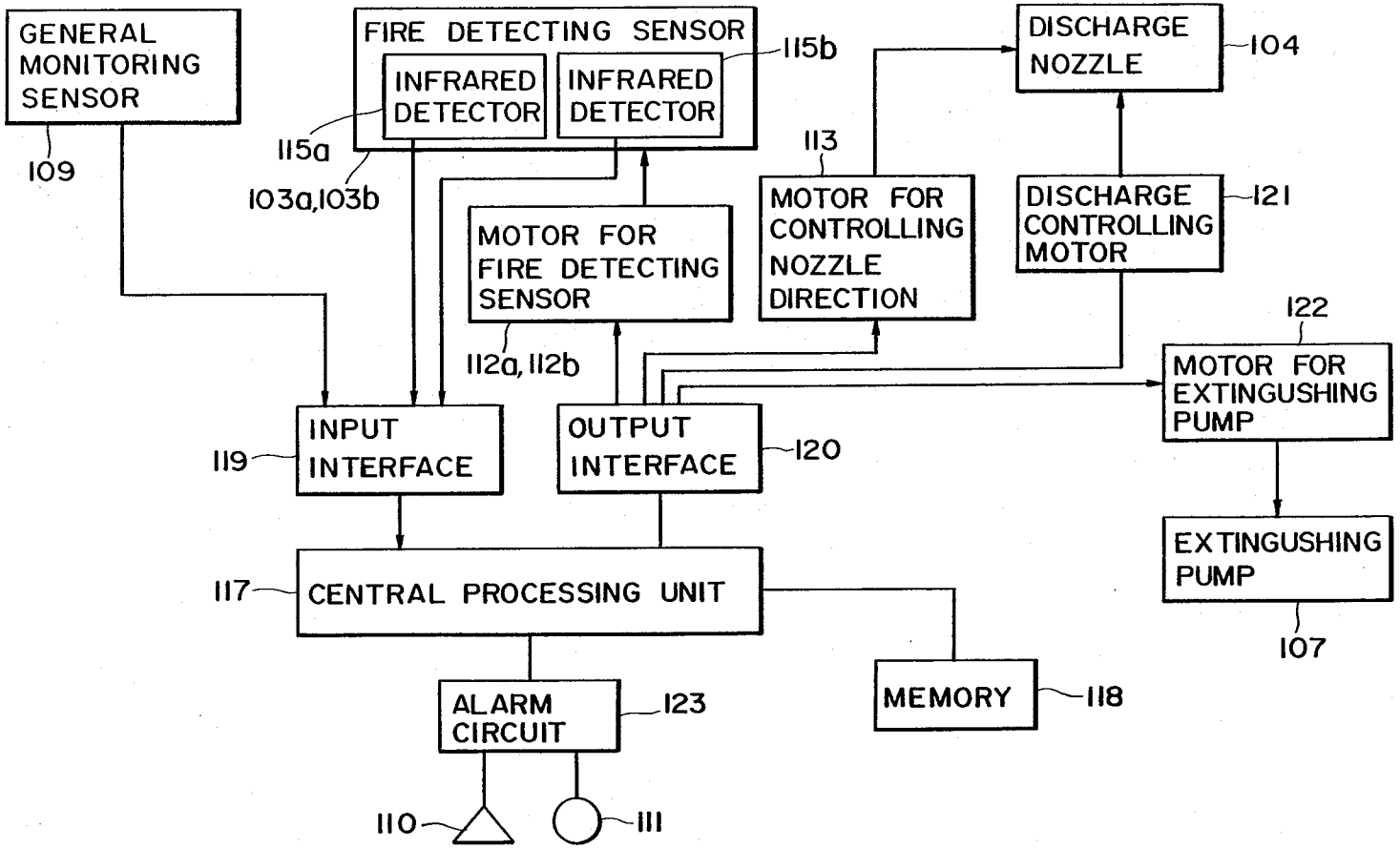
FIG. 10 is a block diagram of one form of a control circuit unit of the second embodiment.

FIG. 10 is a block diagram of one example of the control circuit unit 105 of the second embodiment.

In FIG. 10, 117 designates a microcomputer including memory 118 which stores a program for determining a general direction of a fire source based on the fire detection output from the general monitoring sensor 109, a program for actuating the fire detecting sensors 103*a*, 103*b* in response to the output from the general monitoring sensor 109 and starting the scanning operation by the fire detecting sensors 103*a*, 103*b* around the general direction of the fire source determined as described above, a program for computing a distance to the fire source based on the detected angles of the fire source by the fire detecting sensors 103*a*, 103*b*, a program for setting the angle of the discharge nozzle 104 towards the fire source, a program for controlling the discharge condition, a program for actuating the fire extinguishing pump 107 to start discharging, a program for actuating the alarm buzzer 110 and the indication lamp 111, and so on.

This microcomputer 117 receives the outputs from the general monitoring sensor 109 and the fire detecting sensors 103*a*, 103*b* through an input interface 119. The microcomputer 117 provides control output to the drive mechanisms 112*a*, 112*b* for the fire detecting sensors 103*a*, 103*b*, the drive mechanism 113 for the discharge nozzle 104, a motor 121 for controlling the discharge condition and a motor 122 for driving the fire extinguishing pump 107 through an output interface 120. The microcomputer 117 further provides a drive instruction to the alarm buzzer 110 and the indication lamp 111 through an alarm circuit 123.

Figure 11:
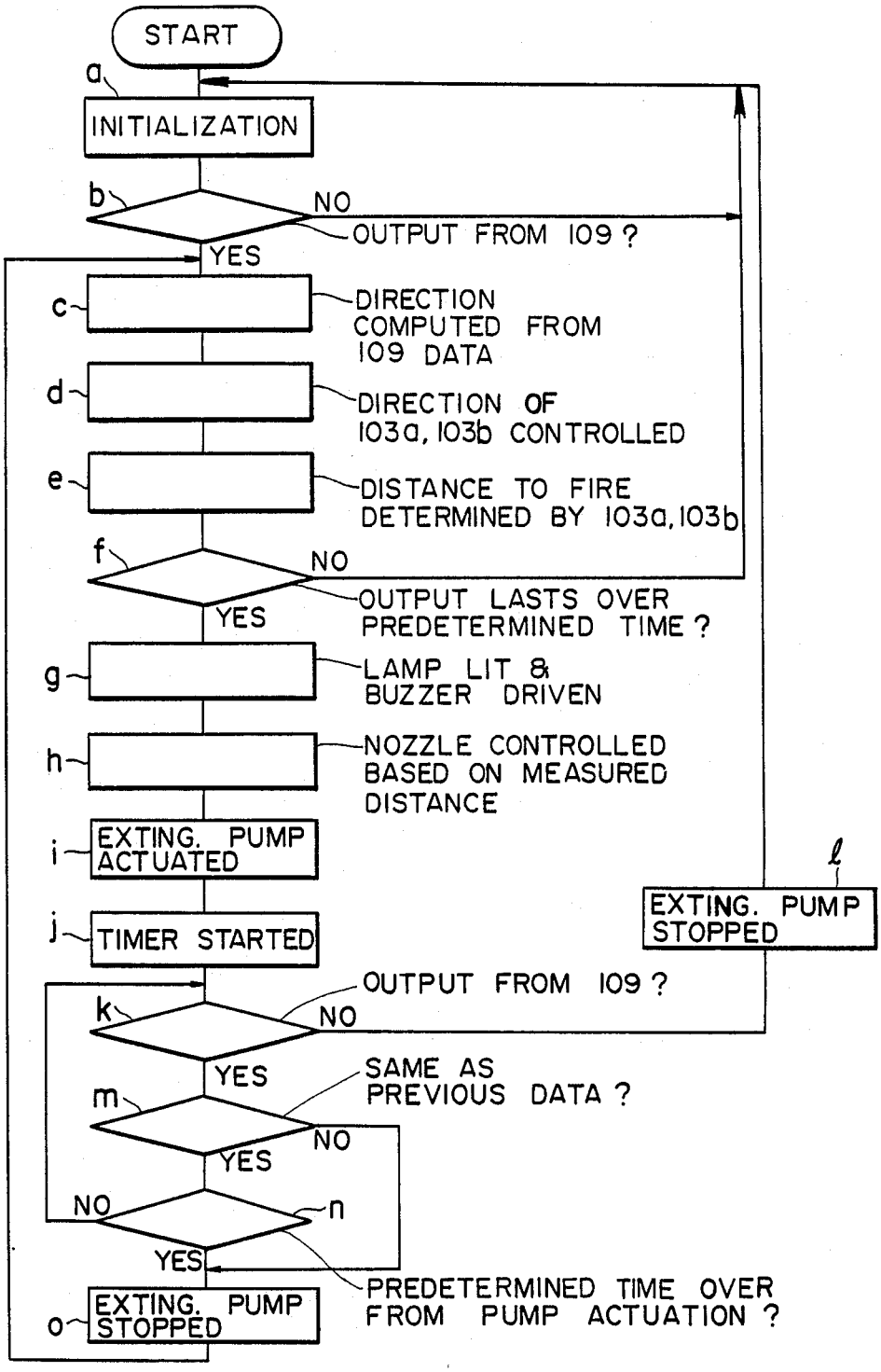
FIGS. 11 and 12 are programming flowcharts of the automatic fire extinguishing system of the second embodiment.

The operation of the present embodiment will now be described referring to a programming flowchart as illustrated in FIG. 11.

Figure 8:
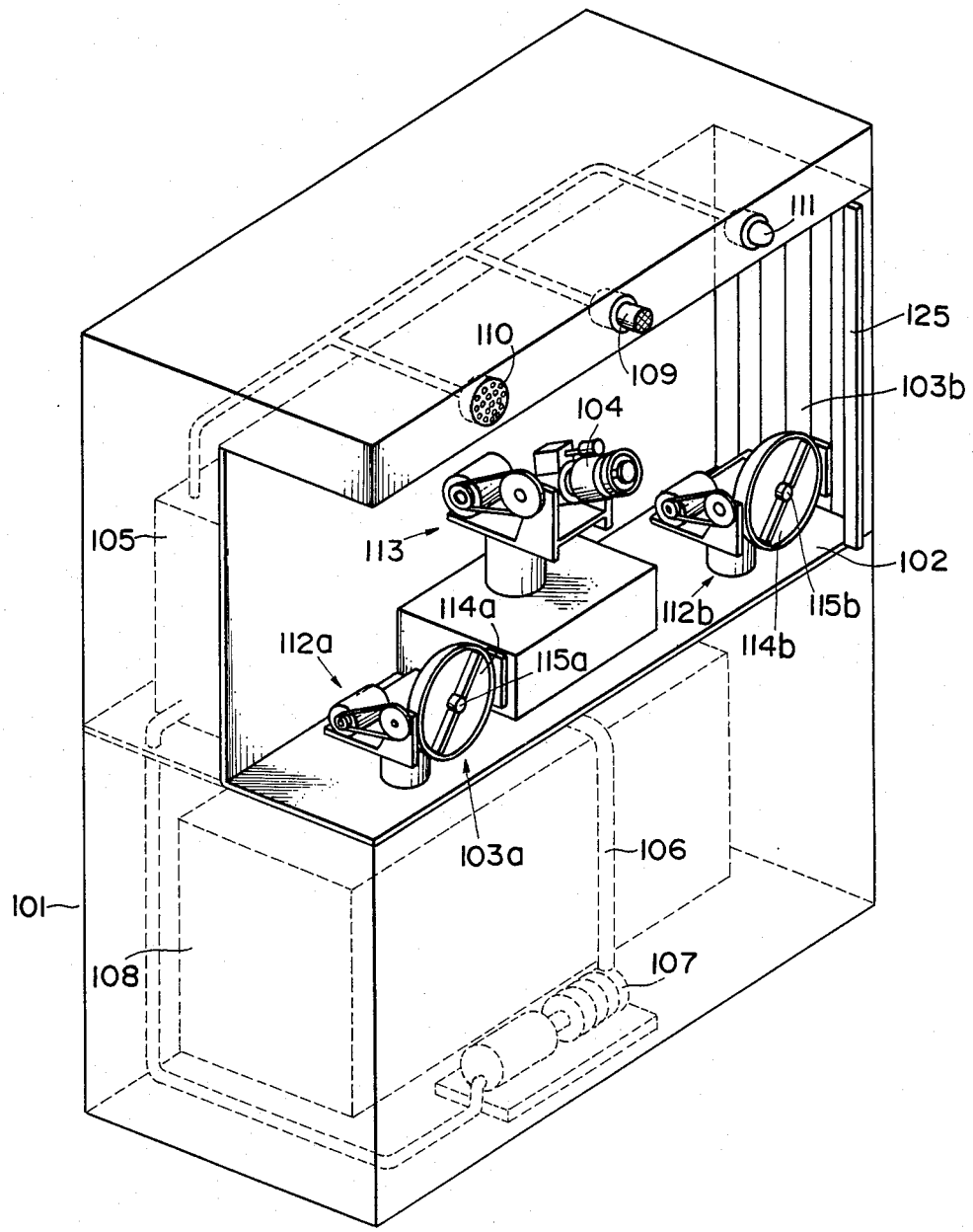
FIG. 8 is a perspective view of an automatic fire extinguishing system according to a second embodiment of the present invention.

First, the power is turned on to the control circuit unit 105 shown in FIG. 8, and the microcomputer 117 of the control circuit unit 105 is set into an initialization as shown by block a in FIG. 11. Then, the general monitoring sensor 109 starts normal monitoring operation and it is decided whether there is a fire detection by the general monitoring sensor 109 (block b). If there is an output from the general monitoring sensor 109, the direction of the fire source is computed from the data from the sensor 109 (block c), the positions for starting the scanning by the fire detecting sensors 103*a*, 103*b* are set (block d) and the distance to the fire source is calculated (block e). Then, it is decided whether the fire detection output from the general monitoring sensor 109 and/or the sensors 103*a*, 103*b* lasts for a predetermined time to decide whether it is a fire or not (block f). When the detection output does not last for the predetermined time, the microcomputer 117 is reset to block a to carry out the normal monitoring operation by the general monitoring sensor 109. When the detection output lasts for the predetermined time, the alarm buzzer 110 is driven and the indication lamp is lit (block g), the direction of the discharge nozzle 104 is controlled (block h), the extinguishing pump 107 is actuated (block i) and a timer is set (block j). The discharge of the extinguishant from the discharge nozzle 104 is carried out for the predetermined time, and then it is decided whether there is an output from the sensor 109 and/or the sensors 103*a*, 103*b* to decide whether the fire has been extinguished or not (block k). When there is no output, the extinguishing pump 107 is stopped and the microcomputer 117 is reset to block a to start the normal monitoring operation again. When there is an output, it is decided whether the detected direction is the same as before or not (block m). If the direction is the same as before, the extinguishing pump 107 is further driven for a predetermined time (block n) and then stopped (block o), and the microcomputer 117 is reset to block c. If the direction is not the same, the microcomputer 117 is reset to block c while keeping the extinguishing pump 107 stopped and the succeeding procedures are repeated.

In this procedure, when the fire is detected, vocal information such as "A fire has started, but fire will be extinguished soon." may be given in addition to the alarming by the buzzer 110.

Figure 12:
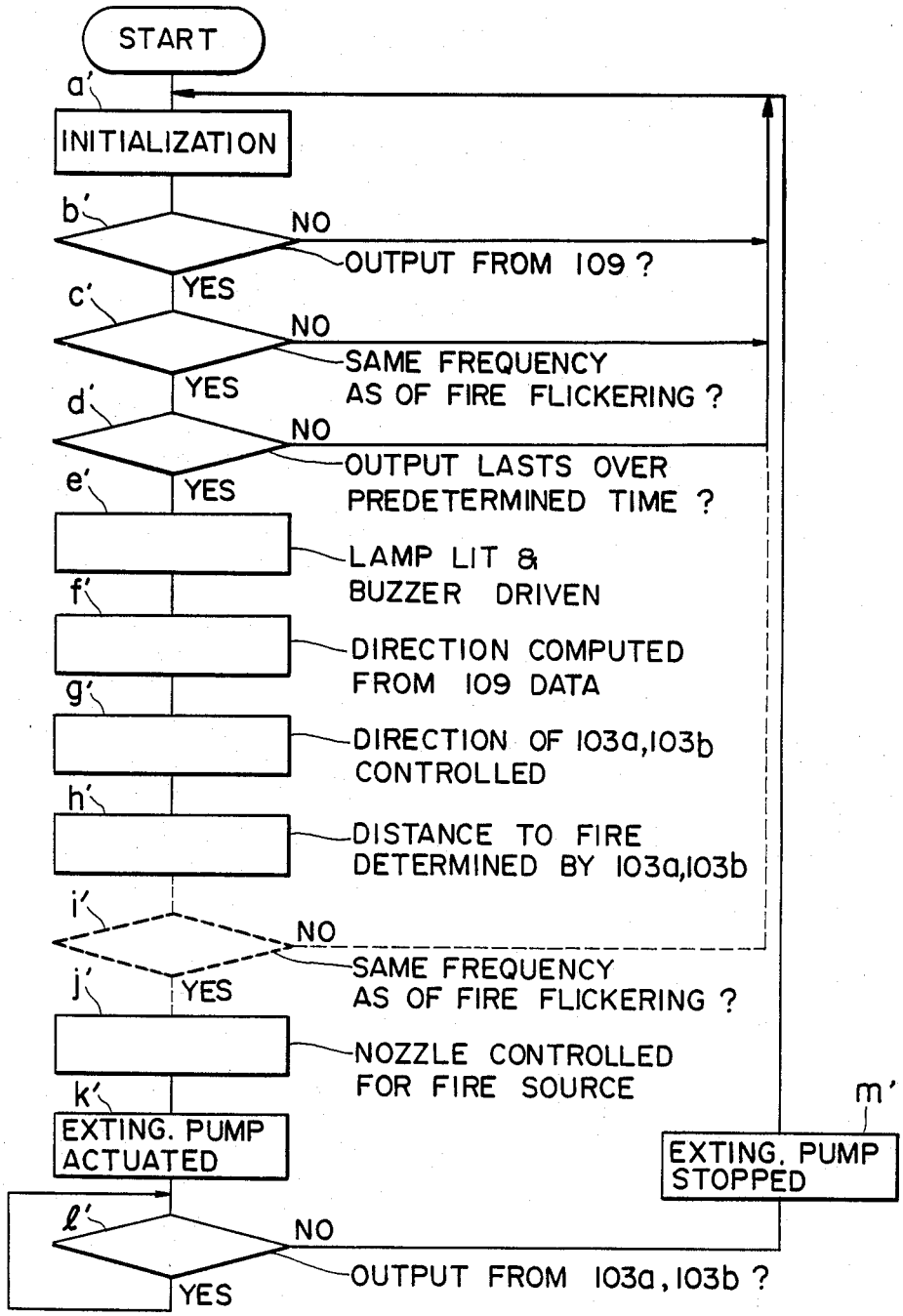

Another mode of operation procedure of the present embodiment will be illustrated in FIG. 12.

As in the first mode of operation procedure, the power is first put on to the control circuit unit 105 to set the microcomputer into initialization (block a'). Then, it is decided whether there is a detection output from the general monitoring sensor 109 (block b'), whether the detection output has a frequency same as that of the flame flicker of the fire (block c'), and whether the output lasts for a predetermined time (block d'). When the answers to the respective questions are "no", the microcomputer 117 is reset to the initialization (block a'). When the answers are "yes", the alarm buzzer 110 is actuated and the indication lamp is lit (block e'), the direction of the fire source is computed from the detection data from the sensor 109 (block f'), the positions for starting the scanning by the sensors 103*a*, 103*b* are controlled (block g'), and the distance to the fire source is calculated from the angles of the fire source detected by the sensors 103*a*, 103*b* (block h'). Thereafter, it is decided whether the detection outputs from the sensors 103*a*, 103*b* have a frequency as of the flame flicker of the fire (block i') to avoid misoperation. If the frequency of the output is not a frequency of the flame flicker, the microcomputer 117 is reset to block a', and if the frequency of the output is the frequency of the flame flicker, the discharge nozzle 104 is controlled relative to the fire source (block j') and the extinguishing pump 107 is actuated (block k'). After the extinguishant has been discharged for a predetermined time, it is decided whether there are outputs from the sensors 103*a*, 103*b* (block l'). When there is no output, the extinguishing pump 107 is stopped (block m') and the microcomputer 117 is reset to block a'. When there are outputs, the decision (block l') is repeated until the outputs disappear.

As described above, according to the present embodiment, the monitoring is normally carried out by the general monitoring sensor 109, and the scanning of the fire source is carried out by the fire detecting sensors 103*a*, 103*b* only after a fire is detected by the sensor 109. Therefore, the automatic fire extinguishing system of the present embodiment may have such a formation that only the general monitoring sensor 109 is exposed at a normal time and the fire detecting sensors 103*a*, 103*b* and the discharge nozzle 104 are hidden behind a door 125 of the main body 101 or under the main body 101 to improve the appearance of the equipment. In this case, the fire detecting sensors 103*a*, 103*b* and the discharge nozzle 104 are drawn out by opening of the door 125 or lifting mechanism.

Although the driving mechanisms for the two fire detecting sensors are common both in the horizontal and vertical directions in the first embodiment and independent of each other both in the horizontal and vertical directions in the second embodiment, they may be common in the horizontal direction and independent in the vertical direction.

The foregoing description only refers to the embodiments of the present invention in which two fire detecting sensors are employed, but the present invention may employ more than two fire detecting sensors according to necessity. Similarly, the number of the discharge nozzle is not limited to one and a plurality of discharge nozzle may be provided.

The equipment of the present invention, especially the main body thereof is not limited to a fixed type and it may be of a movable type. Although both the discharge nozzle and the fire detecting sensors are disposed on the same body in the foregoing embodiments, they may be provided on separate bases.

We claim:

1. An automatic fire extinguishing system comprising:

at least two fire detecting sensors disposed at a distance from each other, each being rotatably directable in the horizontal and vertical directions to scan a region to be protected;

driving means for controllably directing the scan of said fire detecting sensors in the horizontal and vertical directions;

first angular determining means operating to determine the vertical angle of a detected fire source as the lowermost angle at which the boundary of said fire source is detected by said sensors in the vertical scan thereof;

second angular determining means operating to determine the horizontal angle of a detected fire source as the average of the boundary of said fire source detected by said sensors in the horizontal scan thereof;

at least one discharge nozzle for fire extinguishing fluid rotatably directable in the horizontal and vertical directions;

computing means arranged to compute the horizontal distance from said discharge nozzle to said fire source based upon said vertical angle and said horizontal angle as determined by said first and second angular determining means;

driving means for controllably directing said discharge nozzle in the horizontal and vertical directions; and control means for directing said nozzle driving means in the horizontal and vertical directions and operable under control of said computing means to direct said fire extinguishing fluid from said nozzle at said detected fire source in accordance with said vertical and horizontal angles thereof and said distance thereto.

2. An automatic fire extinguishing system as recited in claim 1 wherein said vertical angle of said discharge nozzle is directed upwardly from said determined vertical angle by an amount based upon said computed horizontal distance from said discharge nozzle to said fire source whereby said fire extinguishing fluid is properly directed at said fire source.

3. An automatic fire extinguishing system as recited in claim 1 wherein said fire detecting sensors employ pyroelectric transducers.

4. An automatic fire extinguishing system as recited in claim 1 further comprising means in said discharge nozzle controllable to vary the discharge area thereof, and control means for varying said discharge area in accordance with said computed distance to said fire.

5. An automatic fire extinguishing system as recited in claim 1 further comprising a fixed general monitoring fire sensor responsive to a fire within the region to be protected and operable to actuate operation of said fire extinguishing system in response to detection of a fire.

6. An automatic fire extinguishing system as recited in claim 1 wherein said driving means for directing said fire detecting sensors scans in the vertical direction upwardly from a low angle, and said vertical angle of a detected fire is determined at the lowermost angle at which the boundary of said fire source is detected.

* * * * *